United States Patent [19]

Rush

[11] 4,423,834

[45] Jan. 3, 1984

[54] CONVERTIBLE BACKPACK/CAPE

[76] Inventor: Anne K. Rush, P.O. Box 9223, Berkeley, Calif. 94709

[21] Appl. No.: 327,327

[22] Filed: Dec. 4, 1981

[51] Int. Cl.[3] ..... B65D 30/10

[52] U.S. Cl. ..... 224/151; 224/153; 224/236; 150/52 B; 190/1; 190/901; 383/4

[58] Field of Search ..... 224/153, 150, 155, 209, 224/228, 229, 236, 901, 151; 150/52 B, 52 C, 32; 190/1, 43

[56] References Cited

U.S. PATENT DOCUMENTS

| | | | |
|---|---|---|---|
| 485,509 | 11/1892 | Speed | 190/43 |
| 503,355 | 8/1893 | Phillips | 190/43 |
| 1,085,950 | 2/1914 | Steinthal | 150/52 C |
| 2,764,327 | 9/1956 | Stevenson | 224/236 X |
| 3,185,362 | 5/1965 | Wakefield | 224/155 |
| 4,327,853 | 5/1982 | Adams | 224/228 X |

*Primary Examiner*—Steven M. Pollard
*Attorney, Agent, or Firm*—Townsend and Townsend

[57] ABSTRACT

A structure useable as a backpack or as a cape finds particular utility when worn by a stuffed bear. The backpack/cape structure includes a generally rectangular piece of fabric having top, bottom, and side edges. Side flaps extend outwardly from the side edges along substantially the entire length of the side edges. A top flap extends from the top edge. The article includes a pair of straps which support it on the back of the bear. As a cape the top flap folds over the top edge of the fabric and the fabric and side flaps are substantially unfolded. To transform the structure into a backpack, the side flaps are folded inwardly over the outer surface of the fabric and then the structure is folded upwardly placing the bottom edge under the downwardly folded top flap. The inwardly folded flaps include Velcro fastening strips so that when the structure is folded upwardly the Velcro strips engage to secure the upper and lower portions of the side flaps together to form a pouch-like backpack.

7 Claims, 6 Drawing Figures

CONVERTIBLE BACKPACK/CAPE

FIELD OF THE INVENTION

This invention relates to an article of manufacture convertible from use between a cape and a backpack and particularly suited for wearing by a stuffed animal, such as a bear.

SUMMARY OF THE INVENTION

The present invention is directed to a backpack/cape structure finding particular utility for use with a stuffed bear. The backpack/cape structure includes a generally rectangular piece of fabric having a top, a bottom, and side edges. Side flaps extend outwardly from the side edges along substantially the entire length of the side edges. A top flap extends from the top edge. The structure also includes a pair of straps for insertion of the upper limbs of the bear through the straps for support of the structure on the back of the bear.

When used as a cape the top flap is folded down along the top edge of the piece of fabric while the fabric and side flaps are substantially unfolded. To transform the structure from a cape to a backpack, the side flaps are folded along the side edges inwardly over the outer surface of the fabric and then the structure is folded upwardly generally in half placing the bottom edge under the downwardly folded top flap. The inwardly folded flaps include lengths of fastening material, such as Velcro brand fastening strips, so that when the material is folded upwardly in half the Velcro strips on the flaps secure the upper and lower portions of the side flaps together to form the pouch-like backpack. The top flap is then fastened to the underlying fabric, preferably using Velcro strips.

A primary advantage of the present invention is that the simple design of the cape/backpack allows the article to be made at low cost. The cape structure, convertible to the backpack structure, is a generally rectangular piece of fabric supported on the back of the stuffed bear by simple straps which form loops through which the upper limbs of the bear are inserted. The user is therefore provided with versatility at low cost without sacrificing appearance.

Other features and advantages of the invention will appear from the following description in which the preferred embodiment has been set forth in detail in conjunction with the accompanying drawings.

DETAILED DESCRIPTION OF THE PREFERRED EMBODIMENT

Figure 1:
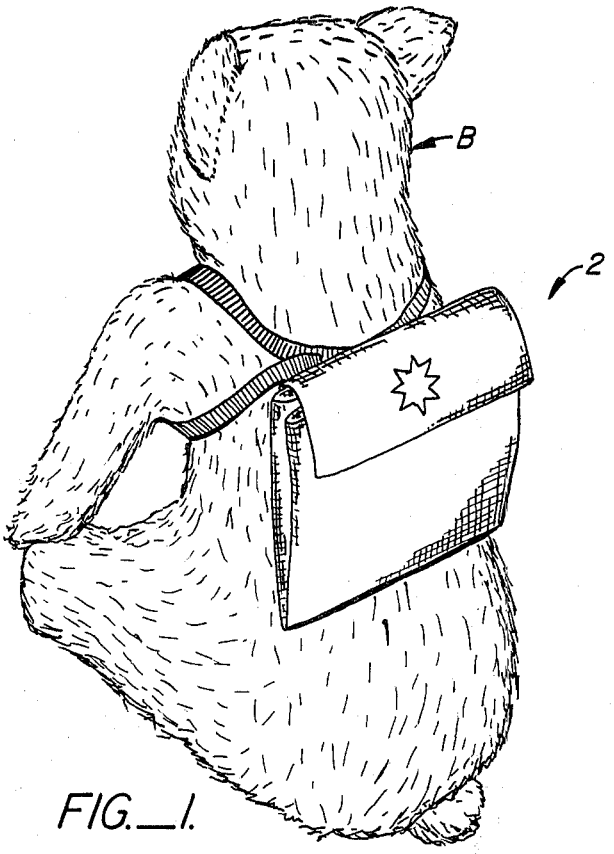
FIG. 1 is a perspective view of the backpack/cape of the present invention in the backpack mode worn by a stuffed bear.

Turning now to FIG. 1, the backpack/cape structure 2 of the present invention is shown worn by a stuffed bear B in the backpack mode. As shown best in FIGS. 2C and 2D, structure 2 includes a generally rectangular piece of material 4 having a bottom edge 6, side edges 8, 10 and a top edge 12. A pair of side flaps 14, 16 extend outwardly from side edges 8, 10 while a top flap 18 extends outwardly from top edge 12. Preferably the piece of material 4, side flaps 14, 16 and top flap 18 are made from a single continuous sheet of material.

Figure 2A:
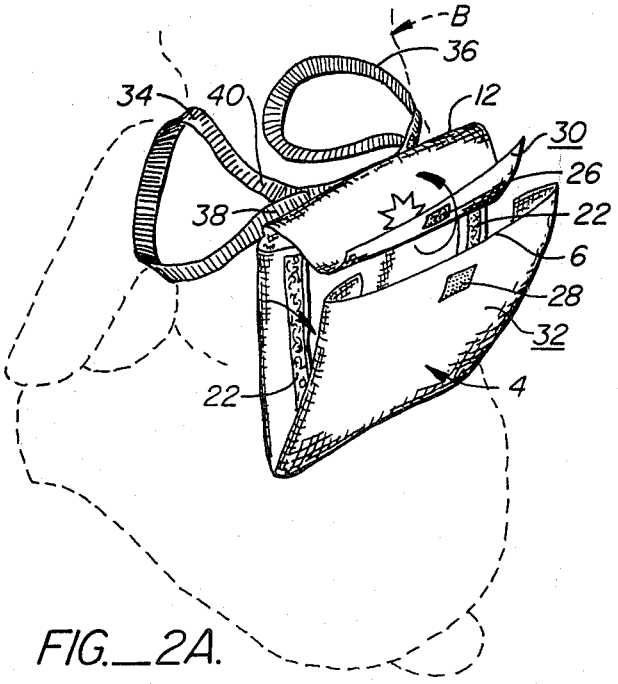
FIGS. 2A–2D are sequential perspective views showing the backpack/cape of FIG. 1 being unfolded from the backpack/mode of FIG. 1A into the cape mode of FIG. 2D.

Complementary Velcro strips 20, 22 (seen in FIG. 2B) are mounted, typically by sewing, along the inside surface 24 of side flaps 14, 16. Engagement of strips 20, 22, in the manner discussed below, allows structure 2 to maintain the backpack mode of FIG. 1. Complementary Velcro tabs 26, 28, shown in FIG. 2A, are attached to a surface 30 of top flap 18 and a surface 32 of material 4 near bottom edge 6 respectively. Engagement of tabs 26, 28 secures top flap 18 to surface 32 to close the top of the structure, defined generally by top edge 12 and bottom edge 6, in the backpack mode.

Figure 3:
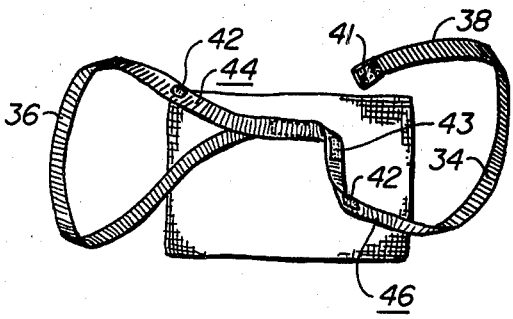
FIG. 3 is a rear view of the backpack/cape of FIG. 1.

Referring now also to FIG. 3, a pair of arm loops 34, 36 are attached to surface 32 of material 4 near top edge 12. An outer end 38 of loop 34 is attached to an inner end 40 of loop 34 using Velcro tabs 41, 43. This allows structure 2 to be easily mounted to bear B by placing one limb of the bear through loop 36 and wrapping the unattached outer end 38 of loop 34 around another limb of bear B and fastening end 38 to end 40 using Velcro tabs 41, 43.

A pair of Velcro tabs 42 (see FIGS. 2C and 3) are mounted to the inner surfaces 44, 46 of loops 34, 36. These tabs are used to attach the upper ends of Velcro strip 22 to arm loops 34, 36 to keep the top of the cape spread across the back of bear B when in the cape mode. Placing tabs 42 on the inside surface insures that they are not visible when structure 2 is in the backpack mode.

Figure 2B:
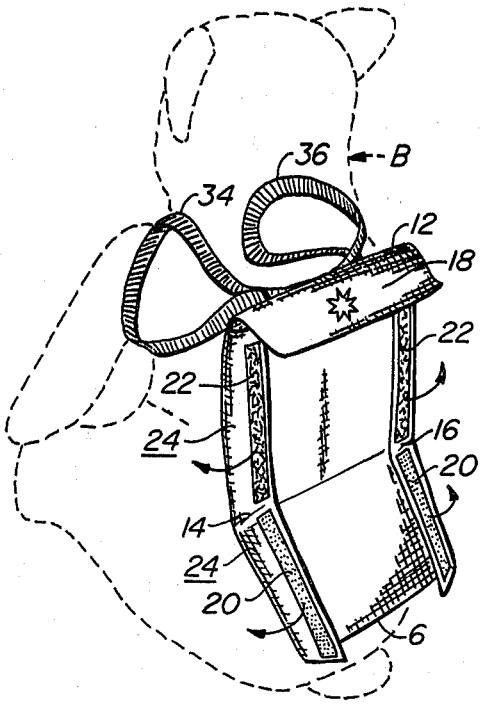
Figure 2C:
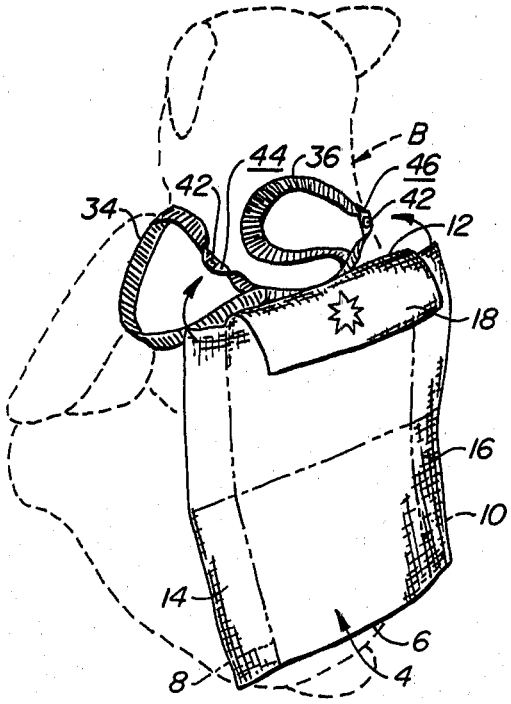
Figure 2D:
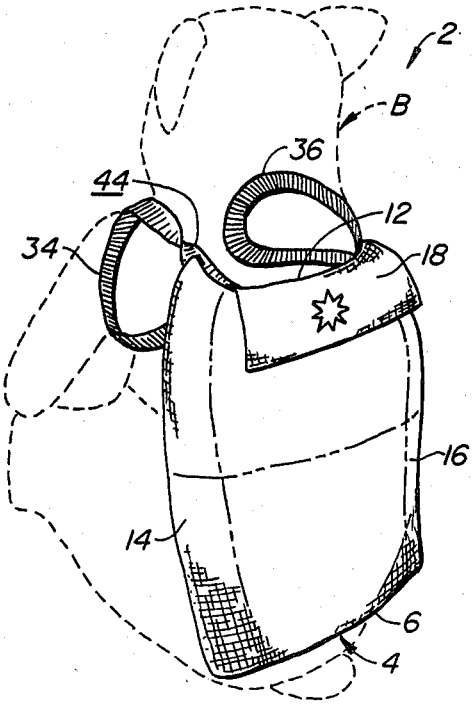

Assuming the backpack/cape structure of the invention is in the backpack mode as shown in FIG. 1, it is transformed into its cape mode by first lifting top flap 18 to disengage Velcro tabs 26, 28 as shown in FIG. 2A. Bottom edge 6 of piece 4 is pulled away from top edge 12 thereby disengaging Velcro strips 20, 22. Side flaps 14, 16 are then folded outwardly as shown in FIGS. 2B and 2C. Arm loops 34, 36 are twisted to expose Velcro tabs 42 mounted to inner surfaces 44, 46 so that an upper portion of Velcro strips 22 can be attached to tabs 42. The cape mode is shown in FIG. 2D. To change structure 2 back into its backpack mode the steps are generally reversed.

Velcro brand fastening tabs and strips have been used in the preferred embodiment for the releasable attachment of the various portions of the structure. However, other means of attachment, such as using snaps, may also be used. Also, if desired Velcro tabs 42 can be mounted to the outer surfaces of arm loops 34, 36 instead of to their inner surfaces. The backpack/cape structure may also be worn by other stuffed animals or by humans if desired. Other modification and variation can be made to the disclosed embodiment without departing from the subject of the invention as defined in the following claims.

I claim:

1. An article of manufacture for use by a wearer as a backpack or as a cape, the article comprising:

a generally rectangular piece of material having side edges, a bottom edge and a top edge, having inner and outer material surfaces;

side flaps extending substantially along said side edges and having inner and outer side flap surfaces;

a top flap extending from said top edge and having inner and outer top flap surfaces;

strap means, connected to the piece of material near the top edge, for supporting said piece of material and flaps therewith against the back of the wearer; and means mounted along the inner side flap surfaces for removably attaching a lower portion of each said side flap to an upper portion of the respective side flap when said side flaps are first folded inwardly to overlie the outer material surface and then said piece of material and side flaps therewith is folded so that upper and lower portions of the outer material surface are opposed and said top and bottom edges are generally proximate one another, whereby said piece of material and said flaps form the cape before folding and form the backpack when so folded.

2. The article of claim 1 wherein said piece of material is rectangular.

3. The article of claim 1 further comprising means for removably attaching said outer surface of said top flap to said inner surface of said material adjacent said bottom edge when folded as a backpack.

4. The article of claim 1 including means for releasably attaching a portion of said side flaps adjacent said top edge to said strap means to keep said material and side flaps extended over the wearer's back when worn as a cape.

5. The article of claim 1 wherein said strap means includes a pair of loop elements adapted to fit around the upper limbs of the wearer.

6. The article of claim 1 wherein said flaps are integral extensions of said piece of material.

7. An article of manufacture for use by a wearer as a cape in a first configuration and a backpack in a second configuration, the article comprising:

a generally rectangular piece of fabric having top, bottom, and side edges;

side flaps extending along the side edges;

a top flap extending from the top edge;

said piece of fabric and said side and top flaps forming a cape structure having outer and inner surfaces;

means, at least partially surrounding a portion of the wearer and attached to said cape structure near the top edge of said piece of fabric, for supporting said cape structure on the wearer;

means, mounted to the inside surface of said side flaps, for releasably binding a lower half of the cape structure to an upper half of the cape structure when said side flaps are folded inwardly with outer surfaces opposed and said cape structure is folded to generally align the top and bottom edges with an upper portion of the outside surface of the piece of fabric facing a lower portion of the outside surface of the piece of fabric thereby forming the backpack structure; and means for releasably sealing the outside surface of the top flap to the inside surface of the piece of fabric adjacent the bottom edge when said top and bottom edges are generally aligned.

* * * * *